United States Patent [19]

Coonrad et al.

[11] Patent Number: 5,014,375

[45] Date of Patent: May 14, 1991

[54] SURGICAL PAD

[75] Inventors: Ralph W. Coonrad, Durham; Carolyn R. Booth, Cary, both of N.C.

[73] Assignee: Span-America Medical Systems, Inc., Greenville, S.C.

[21] Appl. No.: 472,043

[22] Filed: Jan. 29, 1990

[51] Int. Cl.[5] ..... A61G 13/00; A47C 20/00

[52] U.S. Cl. ..... 5/431; 5/437; 5/465; 5/468; 5/481; 5/443

[58] Field of Search ..... 5/431, 436, 437, 446, 5/461, 465, 468, 481, 443

[56] References Cited

U.S. PATENT DOCUMENTS

| | | | |
|---|---|---|---|
| 3,287,747 | 11/1966 | Ellsworth | 5/431 |
| 4,054,960 | 10/1977 | Pettit et al. | 5/461 X |
| 4,579,111 | 4/1986 | Ledesma | 5/431 X |
| 4,840,362 | 6/1989 | Bremer et al. | 5/431 X |
| 4,908,892 | 3/1990 | Michelson | 5/431 |
| 4,944,059 | 7/1990 | Wall | 5/431 |

FOREIGN PATENT DOCUMENTS

| | | | |
|---|---|---|---|
| 2556588 | 6/1985 | France | 269/328 |

OTHER PUBLICATIONS 7 pages of catalog information by Span-America Medical Systems, Inc., P.O. Box 5231, Greenville, SC 29601.

Advertisement by Orthopedic Systems Inc., 1987 National Ave., Hayward, CA 9454-1794, for Andrews SST-3000 Spinal Surgery Table and Andrews Spinal Surgery Frame.

Advertisement for Lex-Ton Orthopedics, P.O. Box 2729, Murfreesboro, TN 37130, for the Heffington Lumbar Seat Spinal Surgery Frame.

*Primary Examiner*—Michael F. Trettel

*Attorney, Agent, or Firm*—Dority & Manning

[57] ABSTRACT

A resilient foam surgical pad is adapted for use with surgery patients supported thereon in a prone position. The patient's abdomen hangs freely in a cavity formed in a torso support block. The reduced pressure on the abdomen lessons the amount of bleeding on the side of the patient opposite the abdomen, particularly during more prolonged surgical procedures. Separate head and leg supporting foam members may be adjusted relative the torso support block to accommodate different patients. A disposable protective covering may be used so that the resilient foam surgical pad may be reused with different patients.

36 Claims, 1 Drawing Sheet

SURGICAL PAD

BACKGROUND OF THE INVENTION

This invention in general concerns an improved patient support pad, and more particularly concerns a resilient pad for use with prone positioned surgery patients to reduce bleeding of such patients during relatively longer surgical procedures.

Numerous positioning devices of various constructions have been provided in foam materials. For example, SpanAmerica Medical Systems, Inc., of Greenville, S.C., markets a number of different products, some of which are intended for operating room use, and others which can be used in more general patient care settings. Such products include an operating room prone pillow and a physical therapy prone pillow which have foam engagement support surfaces for receiving and supporting a patient's head in a prone position while maintaining an open breathing space just below the patient's nose.

Other operating room products of Span-America include support pads comprising convoluted foam mattresses, and armboard pads, also formed of convoluted material. Still, other products are intended for more specific support and/or positioning functions. For example, a foam donut has an 8 inch diameter with a 4 inch diameter central hole, useful for dispersing pressure such as on the ear of a laterally positioned patient. Another device is a 5 inch diameter cylindrical positioning roll which may be placed where desired for pressure dispersion. Various curved pad products properly align a patient's head, neck, shoulders, spin, or legs.

While the foregoing products are tremendously useful for their intended purposes, they generally are not specifically concerned with reducing the level of bleeding by a patient supported in a prone position for rather lengthy surgical procedures, such as 7 to 15 hours in length. It is generally known that as a patient lies on his or her stomach in a prone position for many hours, the added pressure to the abdominal region and to the patient's vascular system results in a greater profusion of blood to the side of the patient opposite the abdomen (i.e., the back or dorsal side). Excessive bleeding (undesirable in any circumstance) is a particular problem during treatment of certain conditions such as scoliosis (spinal curvatures) during which the surgery patient is confined to a prone position for many hours. The greater profusion of blood in the spinal area is particularly problematic as the surgery progresses.

Various efforts have been made to address this problem. Surprisingly, reduced pressure on the abdomen resulting in less constriction of the vascular system results in reduced bleeding rather than increased bleeding. A so-called "Hall Frame" designed by Dr. John Hall of Boston, Mass., comprises an open frame for receipt and support of a patient in a prone position. Essentially, the frame has rubberized supports which undersling the patient's chest and pubic or hip area so that the patient is suspended (wherefore there is no patient abdominal contact with a primary support surface). While direct pressure to the abdomen is eliminated, such a framework disadvantageously permits the entire spine to drop or sag into a concavity, which is undesired particularly for spinal surgery patients. Also, space and access factors become involved during use of a framework. Manipulation of both the framework and the patient is also a potential negative factor regarding practicality of the Hall Frame.

Another prior attempt to reduce abdomen pressure during surgery is to provide a so-called kneeling table. In general, the patient's upper chest is received onto an operating table, and the patient's hip and knee joints are at respective 90 degree angles to the upper chest so that in effect the patient kneels across the operating table. The arrangement requires the introduction of a board immediately behind the buttocks of the patient for pushing the patient forward so that the abdomen will be suspended by contact of the patient's upper chest with the operating table. Obviously, there is a considerable amount of pressure by such arrangement to the front of the patient's legs, and to the knees. The entire arrangement is less than desirable.

Less extensive and less intrusive approaches to abdomen suspension have been attempted. For example, two semicircles of hard rubber approximately 4 inches thick are available in the marketplace. The semicircles are connected by a strap so that their relative placement is adjustable. Generally the semicircles are positioned as a donut or circle underneath the patient's abdomen to act as a surgical pad. Without any particular contouring and without any particular resilient support of the patient, the usefulness of such a positioning device is limited to relatively short operations, such as of only 1 or 2 hours duration. Pressure problems due to the relatively nonresilient nature of the support are problems in longer operations. Also, with only 4 inches thickness and relative compression of the device, an adult patient's abdomen still could come into contact with an underlying primary support surface, and thereby become compressed. Compression on the abdomen is precisely one of the main problems being sought to be avoided. It has also been known to roll towels or pads and simply place same under the top of the chest or beneath the patient's hip area so as to somewhat suspend the abdomen.

SUMMARY OF THE INVENTION

The present invention recognizes and addresses various of the foregoing problems and others, concerning surgical pads. Thus, broadly speaking, a principal object of this invention is improved surgical pads. More particularly, a main concern is to provide an improved surgical pad for receipt and support of a surgery patient in a prone position which acts to reduce bleeding of such patient during relatively longer surgical procedures.

Another present object is to support and cushion a patient during surgery in the prone position, permitting the patient's abdomen to hang freely so as to avoid or reduce abdominal pressure. Specifically, it is desired to resiliently support and cushion the torso of a patient in a prone position, while eliminating or at least greatly reducing abdominal pressure.

Another more particular present object is to provide a surgical pad which at least desirably supports the torso of the patient (either pediatric or adult patients) with an adequate amount of support so that the patient's abdomen will be received in a defined chamber or channel without contacting (i.e., "bottoming out") an underlying primary support surface such as an operating room table or the like.

Yet another more particular object is to alternatively provide respective head and leg support members in addition to a torso support member, all of which are adjustable relative one another by selective repositioning. It is also a present object to provide various adjustability features of the torso support member so that it may be used with a wide range of patients having different physical characteristics. It is a present object to provide a surgical pad generally adjustable for the size of the patient.

As a still further alternative object, it is desired to provide such an improved surgical pad for reduced bleeding of a surgery patient with a removable protective covering to be discarded after each use so that the surgical pad may be reused with different patients.

Another object is to provide such an improved surgical pad made of foam so as to prevent or reduce pressure over bony prominences such as at the pelvis, hips, chest, and breast areas.

Additional objects and advantages of the invention are set forth, or will be apparent to those of ordinary skill in the art, from the detailed description which follows. Also, it should be appreciated that modifications and variations to the specifically illustrated and discussed features hereof may be practiced in various embodiments and uses of this invention without departing from the spirit and scope thereof, by virtue of present reference thereto. Such variations may include, but are not limited to, substitution of equivalent means and features (or materials) for those shown or discussed, and the functional or positional reversal of various parts (features), or the like.

Still further, it should be understood that different embodiments, as well as different presently preferred embodiments, of the present invention may include various combinations of presently disclosed features, or their equivalents (including combinations thereof not expressly shown or stated). One exemplary such embodiment of the present invention relates to a resilient surgical pad for receipt and support of a surgery patient in a prone position. Such pad comprises a block of resilient foam material having a defined lower side thereof adapted for being supported on an operating table, and a defined upper side thereof adapted for generally receiving and supporting the torso of a patient in a prone position thereof. Furthermore, the defined upper side preferably has an opening formed therein and such block defines a cavity beneath such opening and in communication therewith so that the abdomen of a prone positioned patient received on the pad is generally free to hang within such cavity. With such an arrangement, vascular system pressure is lowered for reduced patient bleeding during relatively prolonged surgical procedures.

Another present exemplary embodiment concerns a resilient pad for use with a prone positioned surgery patient to reduce bleeding of such patient during relatively longer surgical procedures. Such a pad includes resilient foam torso support means in accordance with this invention, as well as cavity means in accordance therewith, so that pressure on the patient's abdomen and vascular system is reduced so that bleeding on the patient's side opposite the abdomen is relatively reduced whenever the patient is placed on such pad in a prone position for relatively longer periods of time. Such resilient foam torso support means preferably are adapted for being received on an operating table, and for generally supporting the patient's torso on an upper surface thereof. Such cavity means are preferably formed generally centrally in such torso support means and upper surface thereof, for receiving in free suspension therein a patient's abdomen when such patient assumes a prone position on the torso support means.

Yet another construction comprising a present exemplary embodiment includes a surgical kit for cushioning and supporting a patient in a prone position during surgery. Such kit preferably includes resilient foam torso support means with abdominal channel means formed therein, head support means for supporting the patient's head, and lower limb support means for supporting the patient's lower limbs. The resilient foam torso support means are for resiliently supporting the torso of a patient while the abdominal channel means formed therein are for receiving a patient's abdomen generally in a free hanging condition while the remainder of such torso is resiliently supported.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
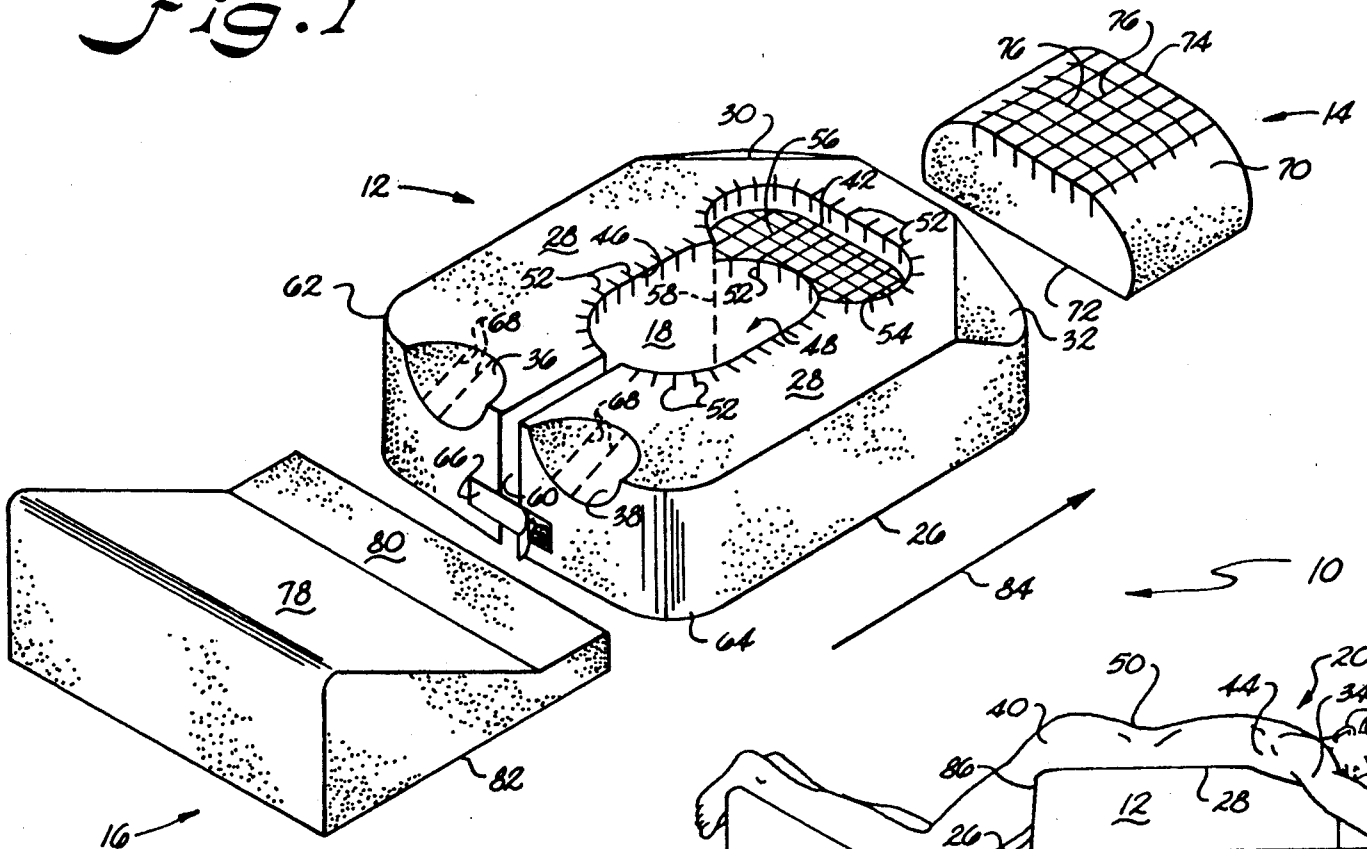
FIG. 1 is a perspective view of an exemplary embodiment of the present invention.

Repeat use of reference characters throughout the present specification and appended drawings is intended to represent same or analogous features or elements of the invention.

DETAILED DESCRIPTION OF THE PREFERRED EMBODIMENTS

FIG. 1 illustrates an exemplary surgical kit 10 in accordance with this invention. Briefly, such arrangement includes a combination of resilient foam torso support means 12, head support means 14 for supporting a patient's head, and lower limb support means 16 for supporting a patient's lower limbs. Cavity means or abdominal channel means 18 are formed in association with torso support means 12. Preferably, support means 14 and 16 (or equivalents or substitutions thereof) are included for improved support of a patient, but an embodiment of this invention may include torso support means 12 and cavity means 18 by themselves, or used in combination with other structures or arrangements for supporting a patient's head or legs.

It is to be understood that the illustration of present FIG. 1 is drawn generally, but not necessarily exactly, to scale, and that features of the present invention are not strictly limited to any given set of dimensions. However, preferred dimensions for certain embodiments are nonetheless disclosed herewith for the sake of providing specific examples after overview of the general construction of the presently preferred embodiments.

Figure 2:
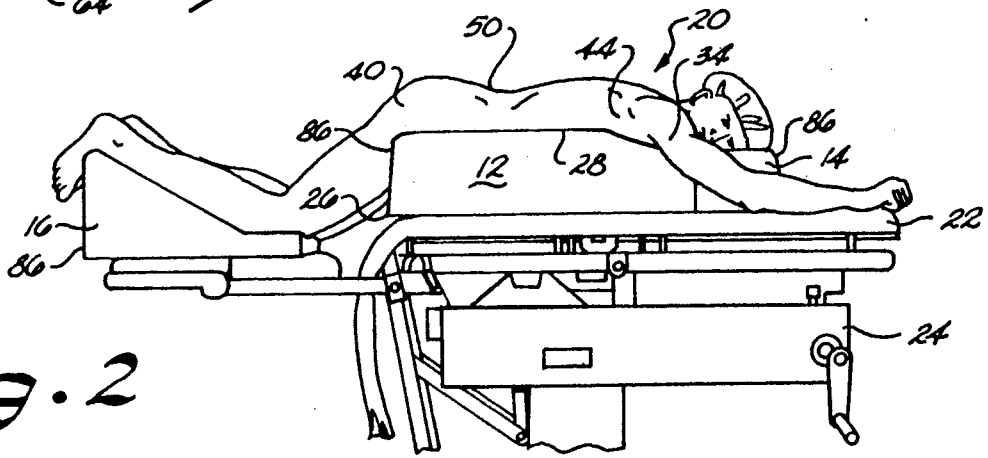
FIG. 2 is a generally side elevational view of the present invention in use on a conventional operating table with a patient received in a prone position thereon.

Torso support means 12 preferably comprises resilient foam material, such as polyurethane foam, for resiliently supporting the torso of a patient. FIG. 2 illustrates in side elevational view receipt and support of an exemplary adult patient 20 on such a torso support means which itself is supported on a primary support surface 22 of a conventional operating table 24. Details of such exemplary conventional operating table are not required for a full and enabling disclosure of the present invention. Moreover, this invention may be practiced not only with operating tables but with virtually any form of primary support surface.

Preferably, torso support means 12 includes a defined lower side 26 adapted for being supported on operating table 24 or some other primary support surface. Defined upper surface or side 28 is adapted for generally receiving and supporting the torso of a patient in a prone position. Both sides 26 and 28 are preferably generally planar, though individual features of each such side or surface may be nonplanar. For example, upper side 28 may be provided with various limb receipt surfaces, such as a pair of angled surfaces 30 and 32 for support of a patient's upper arms 34 as represented in present FIG. 2. Other limb receipt surfaces may be formed, such as a pair of curved surfaces 36 and 38 for support of a patient's upper legs 40 (see FIG. 2). Still further, upper surface 28 may be provided with a recessed generally planar area 42 for support of a patient's upper chest 44.

Cavity means 18 includes both a channel (or cavity) 48 formed generally centrally (preferably) in torso support means 12, as well as an opening 46 defined in upper surface 28 and interconnecting with such channel or cavity 48. With such an arrangement, a patient (such as 20 in FIG. 2) received in a prone position on upper support surface 28 of torso support means 12 is positioned for receipt of the patient's abdomen within cavity means 18. With proper selection of the overall dimensions and density of the foam material comprising torso support means 12 (specific examples of which are disclosed herewith), a patient's abdomen is free to hang within such cavity without contact with or compression by a primary support surface, such as 22 of present FIG. 2. The free hanging condition of the abdomen while the remainder of the patient's torso is resiliently supported and cushioned in a prone position results in lowered vascular system pressure which in turn reduces patient bleeding during relatively prolonged surgical procedures. In particular, the back side 50 of the patient (i.e., dorsal side) opposite the abdominal cavity is one region which benefits from a reduced profusion of blood so that less bleeding in such area results.

For further improved resilient support, various pressure dispersion cuts may be formed in or adjacent upper surface 28. For example, cuts 52 may be formed about the periphery of cavity means 18, and likewise about the periphery of an opening 54 leading to recessed planar area 42. Such planar area 42 may itself have cuts 56 defined in its upper surface. For ease of manufacture, the entire recessed area 42 and its underlying foam material support may be separately formed from the remainder of torso support means 12, as represented by dotted line 58. In other words, initially a channel the size of opening 54 may be formed entirely through the block of material comprising torso support means 12 (i.e., between sides 26 and 28 thereof). Thereafter, a separate piece of foam with recessed support area 42 defined in an upward surface thereof, may be glued or otherwise secured to means 12.

It is not necessary, but preferred, that the cavity or channel 48 formed in torso support means 12 comprise a generally vertical channel interconnecting between lower side 26 and upper side 28 thereof. A partial cavity in place of a complete channel may be used in certain embodiments. However, for maximum adjustability of the present invention, a complete channel is preferred so that, in cooperation with a longitudinal, generally vertical slot 60 formed in one end of torso support means 12, a pair of relatively movable members or portions 62 and 64 of means 12, may be formed. By relatively separating members 62 and 64 from one another, upper leg support surfaces 36 and 38 may be properly positioned to accommodate patients of different sizes. Such upper leg support surfaces may also be provided with pressure dispersion cuts 68. Strap means 66 may comprise a Velcro type (i.e., hook and pile fasteners) arrangement of the like for limiting the amount of separation of members 62 and 64, thereby contributing to the overall stability of torso support means 12.

Head support means 14 and lower limb support means 16 are preferably separate members from torso support means 12, so that selective relative positioning of members 12, 14, and 16 permits further adjustability of the overall surgical kit 10 to accommodate different size patients. Similarly, the size of one means can be changed as needed without having to change the size of the others.

Head support means 14 preferably comprises a block of foam material generally of the same density as that of torso support means 12. Lower limb support means 16 is likewise preferably of the same density, though exact densities of all components may vary. Block 70 may assume various shapes, but preferably has a generally flat bottom surface 72 adapted for being supported on an operating room table of the like. Upper surface 74 thereof for receipt of a patient's head may optionally be provided with pressure dispersion cuts 76 of various depths, placements, etc.

Lower limb support means 16 is preferably wedge shaped, as represented in both FIGS. 1 and 2, so that a patient's feet are relatively elevated to prevent the occurrence of phlebitis. An inclined surface 78 receives a patient's lower legs, while a preferably flat, planar surface 80 supports the patient's knees, all as illustrated in present FIG. 2. A lower planar surface 82 is adapted for receipt on a primary support surface such as the operating room table, also as illustrated in present FIG. 2.

By providing a substantial upper side or surface 28 for support of a patient's torso, torso support means 12 provides resilient support generally to the entirety of such torso region (except the abdomen), while at the same time greatly reducing or eliminating pressure on the abdominal region of the patient. Any undesired sagging of the patient's spinal process is avoided, and at the same time undesired pressure to the back of the patient's legs or to the periphery of the patient's abdomen is eliminated. With such an arrangement, both comfort and care of the patient are improved, particularly for longer duration for surgical procedures of for example 7 to 15 hours, or longer. Also, relatively reduced patient bleeding is another beneficial result from practice of the present invention.

As referenced above, various embodiments of this invention may comprise structures with different dimensions and material densities. When embodied for use with adult patients, preferably the overall thickness of torso support means 12 is generally about 8 inches, with the length (the direction of arrow 84) thereof approximately 28 inches, and its width approximately 22 inches.

With FIG. 1 being drawn generally to scale, such an embodiment for an adult patient has a preferred cavity means dimension in the longitudinal axis (along arrow 84) of approximately 14 inches, and a lateral dimension (perpendicular to the direction of arrow 84) of approximately 8 inches. Arrow 84 is also positioned generally parallel with the spinal axis of a patient as intended to be received on support means 12. The exact dimensions of opening 46 may, of course, be varied, and in particular would preferably be larger for heavier patients (generally having larger abdominal cavities). One possible range of longitudinal lengths is about 12 to 16 inches, while one possible range of lateral lengths is about 6 to 10 inches. Different shaped openings, such as rectangular, or angled, may also be practiced.

For the typical adult patient (for example, of approximately 200 pounds) an 8 inch thick surgical pad provides adequate support if the foam material has a density of at least about 1.4 pounds per cubic foot. To provide desirable cushioning and resilient supporting of the patient, while at the same time ensuring free hanging support of the abdomen, a range of foam densities generally from about 1.4 pounds per cubic foot to about 1.8 pounds per cubic foot is preferred. Heavier adult patients might require increases in either or both of the foam thickness or the foam density.

Those of ordinary skill in the art will also appreciate that relative increases in the foam density (either within the above preferred range or greater than such range) can permit some relative decreases in the overall thickness of the foam pad without detriment to overall performance. Conversely, relative increases in the thickness of the foam pad can permit relative decreases of the foam density for a given embodiment. All such modifications and variations are intended to come within the spirit and scope of the present invention, so long as the resulting surgical pad embodiment generally provides for free hanging support of a given patient's abdomen.

For the typical adult patient, a head support means 14 may comprise a block of foam of approximately 14 inches by 8 inches by 6 inches. The leg support means 16 preferably comprises dimensions of approximately 20 inches by 10 inches by 16 inches. A range of dimensions about each of the preferred values stated is also permissible. Foam density ranges stated above for torso support means 12 are applicable to head support means 14 and leg support means 16, though each foam member is not required to have the same densities.

The present invention may also be used in relative reduced sizes for pediatric patients or the like. For example, one preferred pediatric version of torso support means 12 may have a thickness of approximately 4 inches, with a longitudinal length (in the direction of arrow 84) of about 20 inches and a lateral width (perpendicular to arrow 84) of about 14 inches. A head support means 14 of such an embodiment preferably has dimensions of approximately 10 inches by 4 inches by 3 inches, while leg support means 16 has preferred dimensions of approximately 12 inches by 10 inches by 5 inches. Again, ranges about such values are permitted, and the above stated preferred densities are applicable.

FIG. 2 represents the addition of removable coverings 86 to each of the respective support means, as discussed above. In particular, such removable coverings may comprise a variety of protective materials, but an air permeable, liquid impermeable material is preferred.

Another present advantage due to resilient supporting and cushioning of a patient is improved breathing during prolonged prone positioning. Also, use of the presently described embodiments may be beneficial in nonsurgical settings. For example, due to burns or other localized injuries, it may be desired to relieve abdominal pressure (or contact) while at the same time otherwise resiliently supporting the torso of the patient as much as possible for maximum protection and comfort. All such alternative uses and additional advantages of the above-described constructions likewise are included within the spirit and scope of this invention by virtue of present reference thereto. Similarly, it is to be understood that the foregoing discussion is by way of description and example only and is not intended as adding limitations to the invention, which is set forth more particularly in the appended claims.

We claim:

1. A resilient surgical pad for receipt and support of a surgery patient in a prone position, said pad comprising an integral block of resilient foam material having a defined lower side thereof adapted for being supported on an operating table, and a defined upper side thereof adapted for generally receiving and supporting the torso of a patient in a prone position thereof, wherein said defined upper side has an opening formed therein and said block defines a cavity beneath said opening and in communication therewith so that the abdomen of a prone positioned patient received on said pad is generally free to hang within said cavity, whereby vascular system pressure is lowered for reduced patient bleeding during relatively prolonged surgical procedures, said pad further including a narrow slot formed through one end of said block and interconnecting with said cavity so as to form two relatively movable members in said block for adjustable positioning thereof to customize support of given patients, by adjustable receipt of a patient's upper legs respectively on the upper side of said two relatively movable members.

2. A resilient surgical pad as in claim 1, wherein said lower and upper sides of said block each comprises a generally planar surface.

3. A resilient surgical pad as in claim 1, wherein said resilient foam material has a density of at least about 1.4 pounds per cubic foot.

4. A resilient surgical pad as in claim 1, wherein said cavity comprises a channel formed through said block and interconnecting between said lower and upper sides thereof.

5. A resilient surgical pad as in claim 1, further including adjustable strap means for varying the maximum separation of said two movable members.

6. A resilient surgical pad as in claim 1, further including means for supporting the patient's head.

7. A resilient surgical pad as in claim 1, further including means for supporting the patient's lower limbs.

8. A resilient surgical pad as in claim 1, further including an air permeable, liquid impermeable removable covering over said block, said covering being disposable and replaceable so that said block can be reused.

9. A resilient surgical pad as in claim 1, wherein:

said foam material has a density generally in a range from about 1.4 to about 1.8 pounds per cubic foot;

said block is generally in a range from about 4 inches to about 8 inches thick, depending on whether it is to be used for pediatric or adult patient's; and wherein means for adjustably supporting the patient's head and lower limbs are further provided for association and use with said block.

10. A resilient surgical pad for receipt and support of a surgery patient in a prone position, said pad comprising a block of resilient foam material having a defined lower side thereof adapted for being supported on an operating table, and a defined upper side thereof adapted for generally receiving and supporting the torso of a patient in a prone position thereof, wherein said defined upper side has an opening formed therein and said block defines a cavity beneath said opening and in communication therewith so that the abdomen of a prone positioned patient received on said pad is generally free to hang within said cavity, whereby vascular system pressure is lowered for reduced patient bleeding during relatively prolonged surgical procedures, wherein said block upper side includes contoured limb receipt surfaces defined therein.

11. A resilient surgical pad as in claim 10, wherein said limb receipt surfaces include a pair of angled surfaces for support of a patient's upper arms.

12. A resilient surgical pad as in claim 10, wherein said limb receipt surfaces include a pair of curved surfaces for support of a patient's upper legs.

13. A resilient surgical pad for receipt and support of a surgery patient in a prone position, said pad comprising a block of resilient foam material having a defined lower side thereof adapted for being supported on an operating table, and a defined upper side thereof adapted for generally receiving and supporting the torso of a patient in a prone position thereof, wherein said defined upper side has an opening formed therein and said block defines a cavity beneath said opening and in communication therewith so that the abdomen of a prone positioned patient received on said pad is generally free to hang within said cavity, whereby vascular system pressure is lowered for reduced patient bleeding during relatively prolonged surgical procedures, wherein said upper side includes a relatively recessed support surface for supporting generally a patient's upper chest.

14. A resilient surgical pad for receipt and support of a surgery patient in a prone position, said pad comprising a block of resilient foam material having a defined lower side thereof adapted for being supported on an operating table, and a defined upper side thereof adapted for generally receiving and supporting the torso of a patient in a prone position thereof, wherein said defined upper side has an opening formed therein and said block defines a cavity beneath said opening and in communication therewith so that the abdomen of a prone positioned patient received on said pad is generally free to hang within said cavity, whereby vascular system pressure is lowered for reduced patient bleeding during relatively prolonged surgical procedures, wherein said block includes a plurality of cuts formed therein about the periphery of said upper side opening for greater dispersion of pressure on the patient's torso adjacent such opening.

15. A resilient pad for use with a prone positioned surgery patient to reduce bleeding of such patient during relatively long surgical procedures, said pad including:

resilient foam torso support means adapted for being received on an operating table, and for generally supporting a patient's torso on an upper surface thereof; and cavity means, formed generally centrally in said torso support means and upper surface thereof, for receiving in free suspension therein a patient's abdomen when such patient assumes a prone position on said torso support means;

wherein pressure on the patient's abdomen and vascular system is reduced so that bleeding on the patient's side opposite the abdomen is relatively reduced whenever the patient is placed on said pad in a prone position for relatively long periods of time; and further including resilient foam head support means for supporting the patient's head; and resilient foam leg support means for supporting the patient's lower legs.

16. A resilient pad as in claim 15, wherein:

said torso support means comprises a block of foam material having a density preferably of at least about 1.4 pounds per cubic foot and a thickness preferably of at least about 4 inches; and said cavity means comprises a generally vertically oriented channel formed in said block of foam material.

17. A resilient pad as in claim 15, wherein:

said torso support means and said head support means include pressure dispersion cuts formed in or adjacent upper support surfaces thereof for improved support of a patient thereon; and said leg support means generally comprises a wedge shaped member for elevating a patient's feet relative the remainder of the patient's lower legs; and wherein said resilient pad may be adjusted for custom usage with different patients by selectively arranging the relative distances and positions among said torso support means, head support means and leg support means.

18. A resilient pad as in claim 15, wherein:

said head support means and leg support means each comprises an integral foam member separate from said torso support means; and wherein said cavity means generally comprises a channel formed through said torso support means, and having a generally elongated cross-section, the elongated axis of which generally runs parallel with the intended position of the spinal axis of a patient received on said torso support means.

19. A resilient pad for use with a prone positioned surgery patient to reduce bleeding of such patient during relatively long surgical procedures, said pad including:

resilient foam torso support means adapted for being received on an operating table, and for generally supporting a patient's torso on an upper surface thereof; and cavity means, formed generally centrally in said torso support means and upper surface thereof, for receiving in free suspension therein a patient's abdomen when such patient assumes a prone position on said torso support means;

whereby pressure on the patient's abdomen and vascular system is reduced so that bleeding on the patient's side opposite the abdomen is relatively reduced whenever the patient is placed on said pad in a prone position for relatively long periods of time; wherein said torso support means further includes pressure dispersion cuts therein about the periphery of said cavity means, at least one angled surface near one end of said torso support means for support of a patient's upper arm, a recessed generally planar area near said torso support means one end for support of a patient's upper chest, and at least one curved surface near an end of said torso support means opposite said one end thereof for support of a patient's upper leg.

20. A resilient pad as in claim 19, including a pair of said angled surfaces and a pair of said curved surfaces, and further including through said torso support means a generally vertical slot between said curved surfaces and interconnecting said cavity means with the outside periphery of said torso support means, whereby lateral separation between said pair of curved surfaces may be varied, and wherein said resilient pad further includes strap means, interconnecting opposing portions of said torso support means defined on either side of said slot therein, for limiting the amount of lateral separation therebetween, whereby said resilient pad may be adjusted for use with different sized patients.

21. A surgical kit for cushioning and supporting a patient in a prone position during surgery, comprising:

resilient foam torso support means for resiliently supporting the torso of a patient, said torso support means having abdominal channel means formed therein for receiving a patient's abdomen generally in a free-hanging condition while the remainder of such torso is resiliently supported;

head support means for supporting the patient's head; and lower limb support means for supporting the patient's lower limbs;

wherein said head support means and lower limb support means comprise respective foam members apart from said torso support means so as to be adjustably positioned relative thereto on an operating table or other primary support surface.

22. A surgical kit as in claim 21, wherein:

said torso support means comprises foam material generally having at least about 1.4 pounds per cubic foot density and at least about 4 inches thickness.

23. A surgical kit as in claim 22, wherein said torso support means is about 8 inches thick, about 28 inches long, and about 22 inches wide so as to resiliently support the full torso of a typical adult patient without compression of said resilient foam torso support means to the point that the patient's abdomen would engage a primary support surface below.

24. A surgical kit as in claim 23, wherein said abdominal channel means comprises a generally vertical channel formed through said torso support means and having a generally elongated cross-section, the elongated axis of which is generally about 12 to 16 inches and the lateral axis of which is generally about 6 to 10 inches.

25. A surgical kit as in claim 21, wherein each of said support means is respectively covered by removable, liquid resistant, air permeable drapes, whereby such drapes may be replaced so that said surgical kit may be reused for different patients.

26. A surgical kit for cushioning and supporting a patient in a prone position during surgery, comprising:

resilient foam torso support means for resiliently supporting the torso of a patient, said torso support means having abdominal channel means formed therein for receiving a patient's abdomen generally in a free-hanging condition while the remainder of such torso is resiliently supported;

head support means for supporting the patient's head; and lower limb support means for supporting the patient's lower limbs;

wherein an upper support surface of said torso support means is contoured for receipt and support of a patient's upper arms, upper chest, and upper legs.

27. A surgical kit as in claim 26, wherein said upper support surface includes a pair of curved surfaces for receipt and support of a patient's upper legs.

28. A surgical kit as in claim 27, wherein said pair of curved surfaces include pressure dispersion cuts formed therein.

29. A surgical kit as in claim 27, wherein said curved surfaces are situated adjacent to an edge of said upper support surface.

30. A surgical kit as in claim 26, wherein said upper support surface includes a relatively recessed support surface for supporting generally a patient's upper chest.

31. A surgical kit as in claim 30, wherein said relatively recessed support surface includes pressure dispersion cuts formed therein.

32. A surgical kit as in claim 26, wherein said upper support surface further includes a pair of angled surfaces adjacent an edge thereof for receipt and support of a patient's upper arms.

33. A surgical kit for cushioning and supporting a patient in a prone position during surgery, comprising:

resilient foam torso support means for resiliently supporting the torso of a patient, said torso support means having abdominal channel means formed therein for receiving a patient's abdomen generally in a free-hanging condition while the remainder of such torso is resiliently supported;

head support means for supporting the patient's head; and lower limb support means for supporting the patient's lower limbs;

wherein said torso support means has an upper support surface with pressure dispersion cuts formed therein.

34. A surgical kit as in claim 33, wherein said pressure dispersion cuts are formed adjacent said abdominal channel means.

35. A surgical kit as in claim 33, wherein said upper support surface includes a relatively recessed support surface for supporting generally a patient's upper chest.

36. A surgical kit as in claim 35, wherein said relatively recessed support surface includes pressure dispersion cuts formed therein and formed in said upper support surface adjacent thereto.

* * * * *